United States Patent [19]

Yuge et al.

[11] Patent Number: 4,787,518

[45] Date of Patent: Nov. 29, 1988

[54] PAPER SHEET SORTING APPARATUS

[75] Inventors: Akio Yuge; Hiroshi Watanabe, both of Yokohama, Japan

[73] Assignee: Kabushiki Kaisha Toshiba, Kawasaki, Japan

[21] Appl. No.: 907,159

[22] Filed: Sep. 15, 1986

Related U.S. Application Data

[63] Continuation of Ser. No. 649,483, Sep. 11, 1984, abandoned.

[30] Foreign Application Priority Data

Sep. 14, 1983 [JP] Japan ..... 58-168232

[51] Int. Cl.[4] ..... B07C 5/344

[52] U.S. Cl. ..... 209/534; 209/551; 235/379; 271/298

[58] Field of Search ..... 209/534, 551, 563–566; 194/205–207; 235/379, 475–477; 271/3.1, 4, 9, 288, 298, 303

[56] References Cited

U.S. PATENT DOCUMENTS 4,236,639 12/1980 Boettge et al. ..... 209/534
4,273,649 6/1981 Leverett ..... 209/564 X
4,299,326 11/1981 Ulch ..... 209/564
4,465,192 8/1984 Ohba et al. ..... 209/534
4,522,486 6/1985 Clark et al. ..... 271/288 X

FOREIGN PATENT DOCUMENTS 52-69695 9/1977 Japan ..... 209/534
58-176772 10/1983 Japan ..... 235/379
59-53358 3/1984 Japan ..... 209/534

*Primary Examiner*—Robert B. Reeves
*Assistant Examiner*—Edward M. Wacyra
*Attorney, Agent, or Firm*—Cushman, Darby & Cushman

[57] ABSTRACT

There is provided a paper sheet sorting apparatus which has a bill supply port at which a plurality of bills having various denominations are set, a discrimination unit for discriminating the denomination of the bills supplied one by one from the supply port, and a stacking control unit for stacking the bills specified by the specification unit in predetermined stacking units in correspondence with a discrimination result. The denomination of the bills which are stacked in the respective stacking units is not previously determined, and an operator can easily change/set the bills by various specification keys.

14 Claims, 14 Drawing Sheets

| | | | | |
|---|---|---|---|---|
| $100 | FIT | BILL | TABLE | ADDRESS |
| $100 | UNFIT | BILL | TABLE | ADDRESS |
| $50 | FIT | BILL | TABLE | ADDRESS |
| $50 | UNFIT | BILL | TABLE | ADDRESS |
| $20 | FIT | BILL | TABLE | ADDRESS |
| $20 | UNFIT | BILL | TABLE | ADDRESS |
| $10 | FIT | BILL | TABLE | ADDRESS |
| $10 | UNFIT | BILL | TABLE | ADDRESS |
| $5 | FIT | BILL | TABLE | ADDRESS |
| $5 | UNFIT | BILL | TABLE | ADDRESS |
| $2 | FIT | BILL | TABLE | ADDRESS |
| $2 | UNFIT | BILL | TABLE | ADDRESS |
| $1 | FIT | BILL | TABLE | ADDRESS |
| $1 | UNFIT | BILL | TABLE | ADDRESS |

PAPER SHEET SORTING APPARATUS

This is a continuation of application Ser. No. 649,483, filed Sept. 11, 1984, which was abandoned upon the filing hereof.

BACKGROUND OF THE INVENTION

The present invention relates to a paper sheet sorting apparatus in which paper sheets of different types can be sorted and stacked.

A bill sorting apparatus has been proposed as an apparatus of this type in which a plurality of bills of various denominations are received once, the denominations thereof are automatically discriminated one by one, discriminated bills of each denomination are stacked in corresponding stacking units upon counting them, thus sorting the bills. In such a conventional apparatus, the number of different denominations of bills currently in use does not correspond to that of the stacking units, and only a limited number of stacking units are provided. Each stacking unit is assigned a predetermined denomination, and this assignment cannot be changed.

The above-mentioned bill sorting operation is nowadays performed in various types of business, and the properties of bills ar different in each type of business. Therefore, predetermined bills are conventionally stacked in certain stacking units, resulting in low efficiency. For example, one conventional apparatus has four stacking units of $100, $50, $20 and $10. However, one business may wish to stack bills of other denominations in addition to these denominations. In another business, there are few $10 bills, and there are many $20 bills in comparison to $100 and $50 bills. In this case, $20 bills are stacked in two stacking units, and $100 and $50 bills are respectively stored in corresponding stacking units, and $10 bills are rejected and not stacked (not sorted). The reason is that, when one stacking unit becomes full, the sorting operation must be stopped. Furthermore, still another business may wish to stack unspecified denominations in one stacking unit and stacking specified denomination in all other stacking units. This kind of free sorting stacking function is demanded, but only fixed sorting stacking function is provided by conventional apparatus.

SUMMARY OF THE INVENTION

It is an object of the present invention to provide a paper sheet sorting apparatus which has a plurality of stacking units and can stack paper sheets in correspondence with a type thereof in a corresponding stacking unit, wherein the types of paper sheets to be stacked in respective stacking units can be easily changed.

In order to achieve the above object of the present invention, there is provided a paper sheet sorting apparatus comprising a paper sheet supply port on which a plurality of paper sheets of various denominations are set, a pick-up unit for picking up the paper sheets one by one from the paper sheet supply port, a discrimination unit for discriminating a denomination of the paper sheet picked up by the pick-up unit, a plurality of stacking units in which the paper sheets picked up by the pick-up unit are stacked, a specification unit for setting denominations of the paper sheets to be stacked in each of said stacking units, and a stacking control unit for stacking the paper sheets picked up by the pick-up unit in the stacking units specified by the specification unit in accordance with a discrimination result of the discrimination unit.

DETAILED DESCRIPTION OF THE PREFERRED EMBODIMENT

Figure 1:
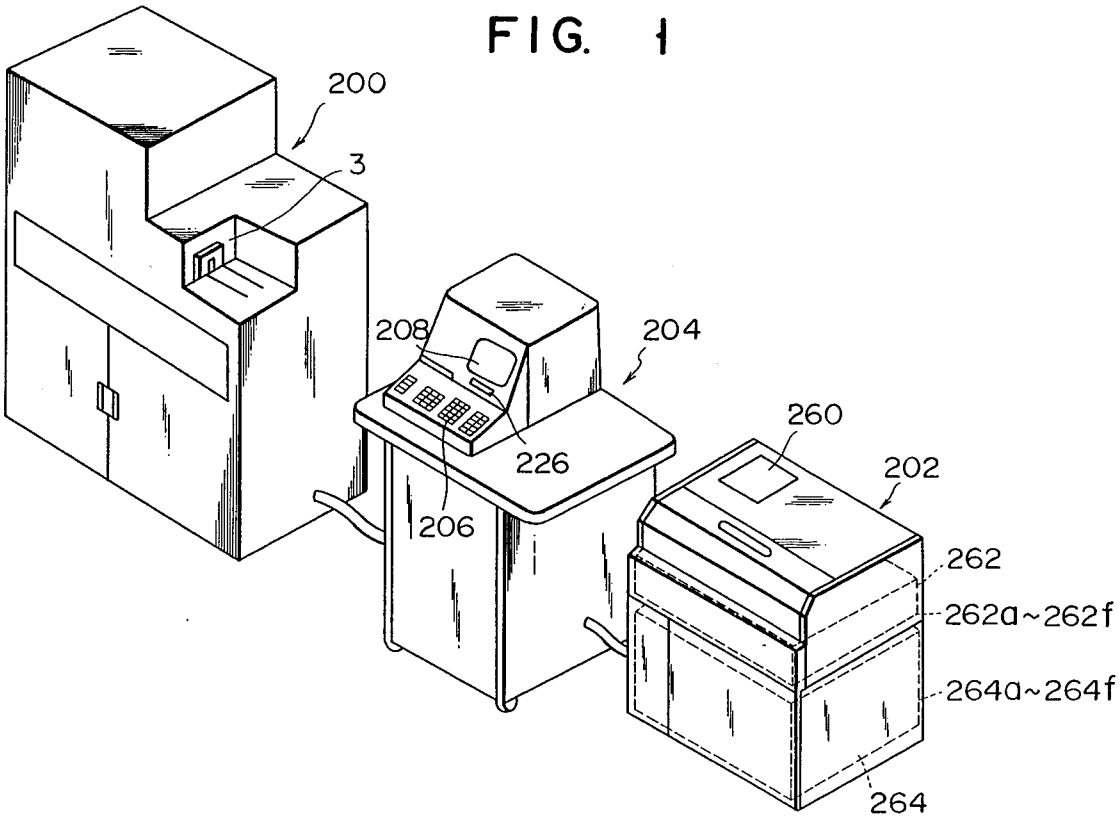
FIG. 1 is a perspective view of an entire money sorting apparatus including a bill sorting apparatus as an embodiment of the present invention.
Figure 2:
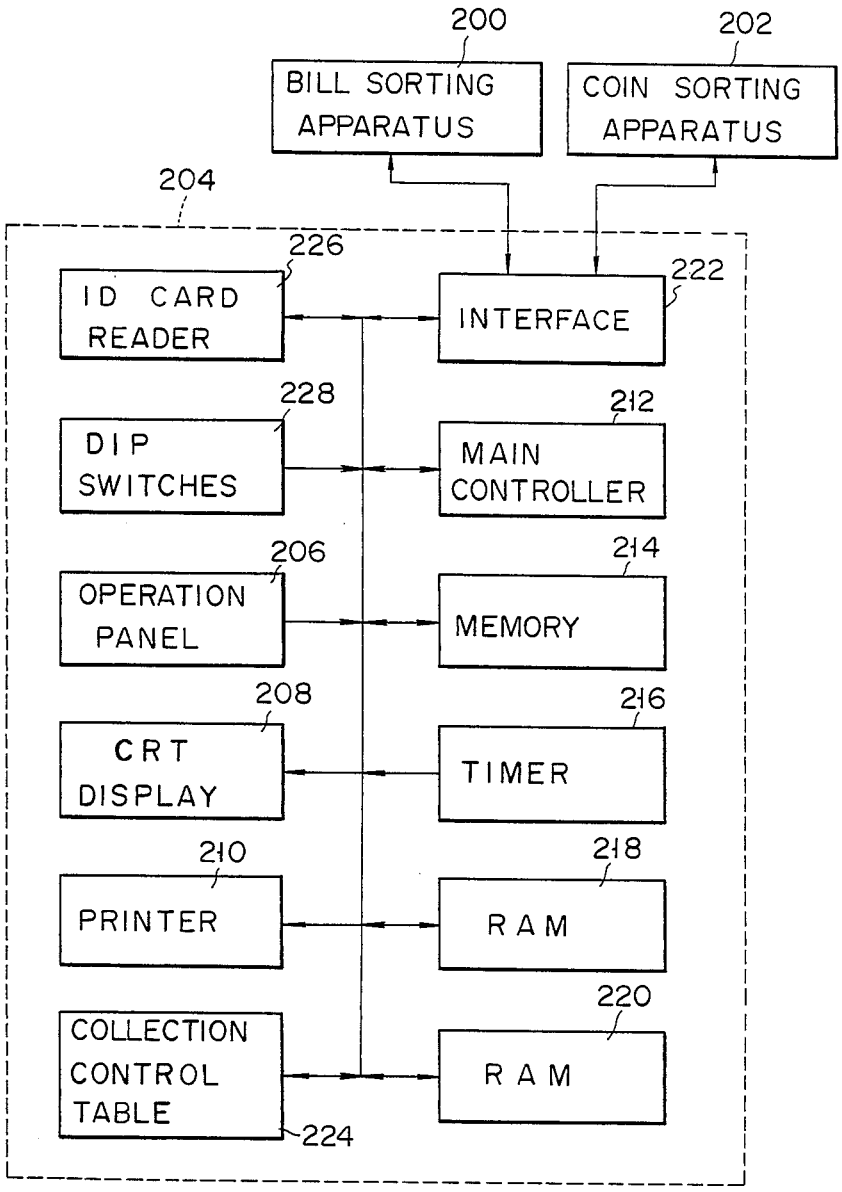
FIG. 2 is a block diagram of a control circuit of the money sorting apparatus of FIG. 1.

A paper sheet sorting apparatus of an embodiment of the present invention will now be described with reference to the accompanying drawings. In this case, the paper sheets are bills. FIG. 1 is a perspective view showing an entire money sorting apparatus, and FIG. 2 is a block diagram showing a control circuit of this money sorting apparatus. This money sorting apparatus comprises a bill sorting apparatus 200 as an embodiment of the present invention, a coin sorting apparatus 202 and an operation display apparatus 204. The operation display apparatus 204 comprises an operation panel 206, a CRT display 208, a printer 210, a main controller 212 which controls the entire operation of the apparatus, a memory 214, a timer 216, RAMs 218 and 220, an interface 222 which performs data control between the bill sorting apparatus 200 and the coin sorting apparatus 202, a stacking control table 224, an ID card reader 226 and DIP switches 228.

Figure 3:
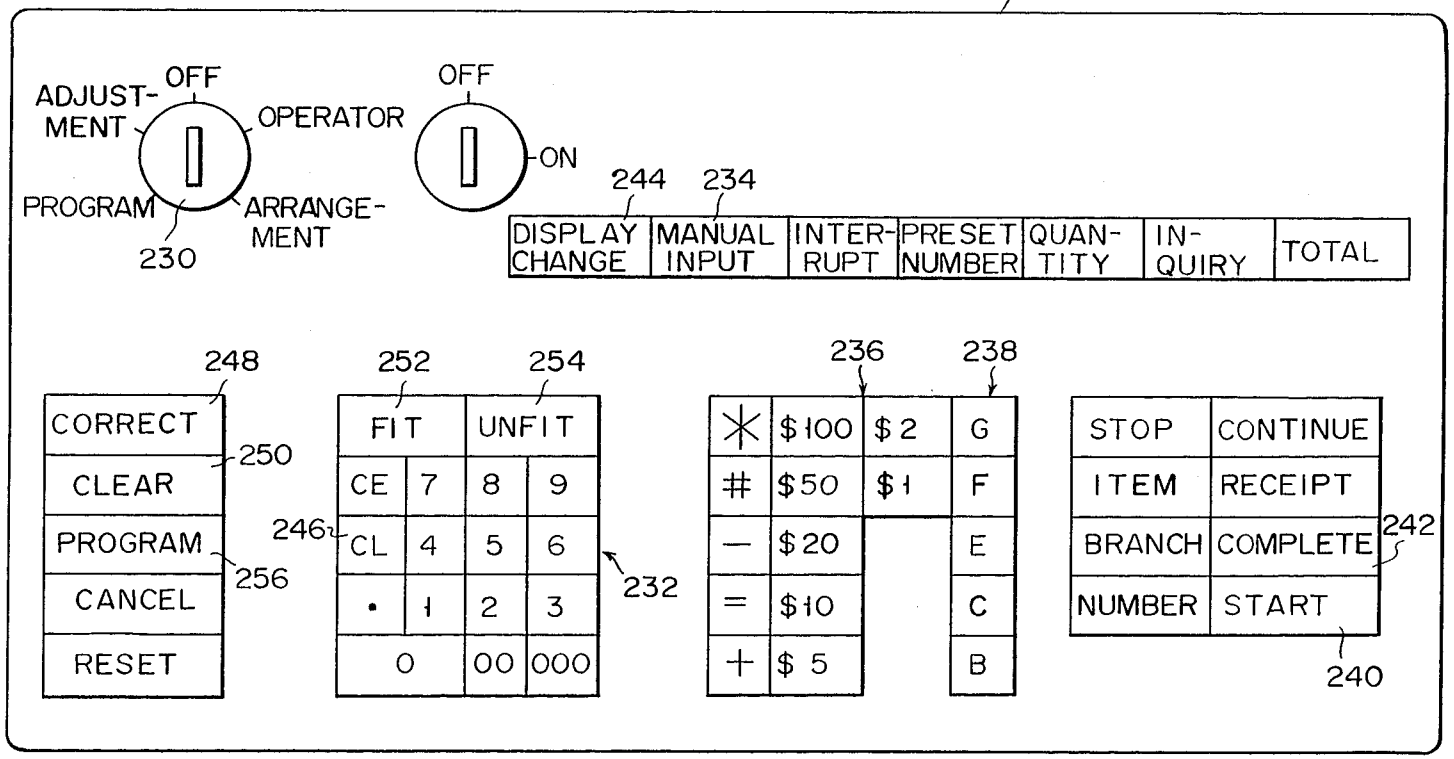
FIG. 3 is a plan view showing a key arrangement of an operation panel of the bill sorting apparatus of the embodiment of the present invention.

As shown in FIG. 3 the operation panel 206 comprises a mode switch 230, numerical keys 232, a manual input key 234, denomination specification keys 236, function keys 238 showing the types of checks, securities and notes, a start key 240 for starting the counting operation, a complete key 242 for finishing the operation, a display change key 244 for displaying a content of 14 current manual input data, a clear key 246, a correct key 248 for correcting all the manual input data, a clear key 250 for correcting one of the manual input data, fit and unfit keys 252 and 254, a program key 256 and the like. The mode switch 230 can designate an "off", "operator", "arrangement", "adjustment" and the like only when the supervisor's key or the serviceman's key is inserted. It should be noted that the manual input key 234 and the start key 240 are respectively self illuminating keys.

Figure 4:
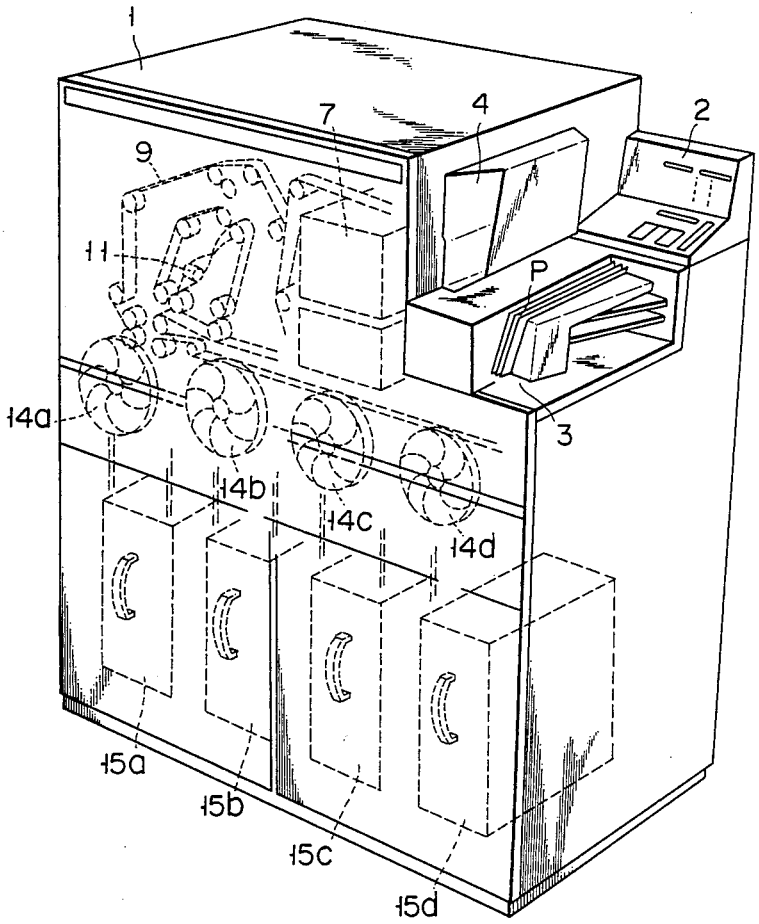
FIG. 4 is a perspective view showing a structure of the bill sorting apparatus of this embodiment.
Figure 5:
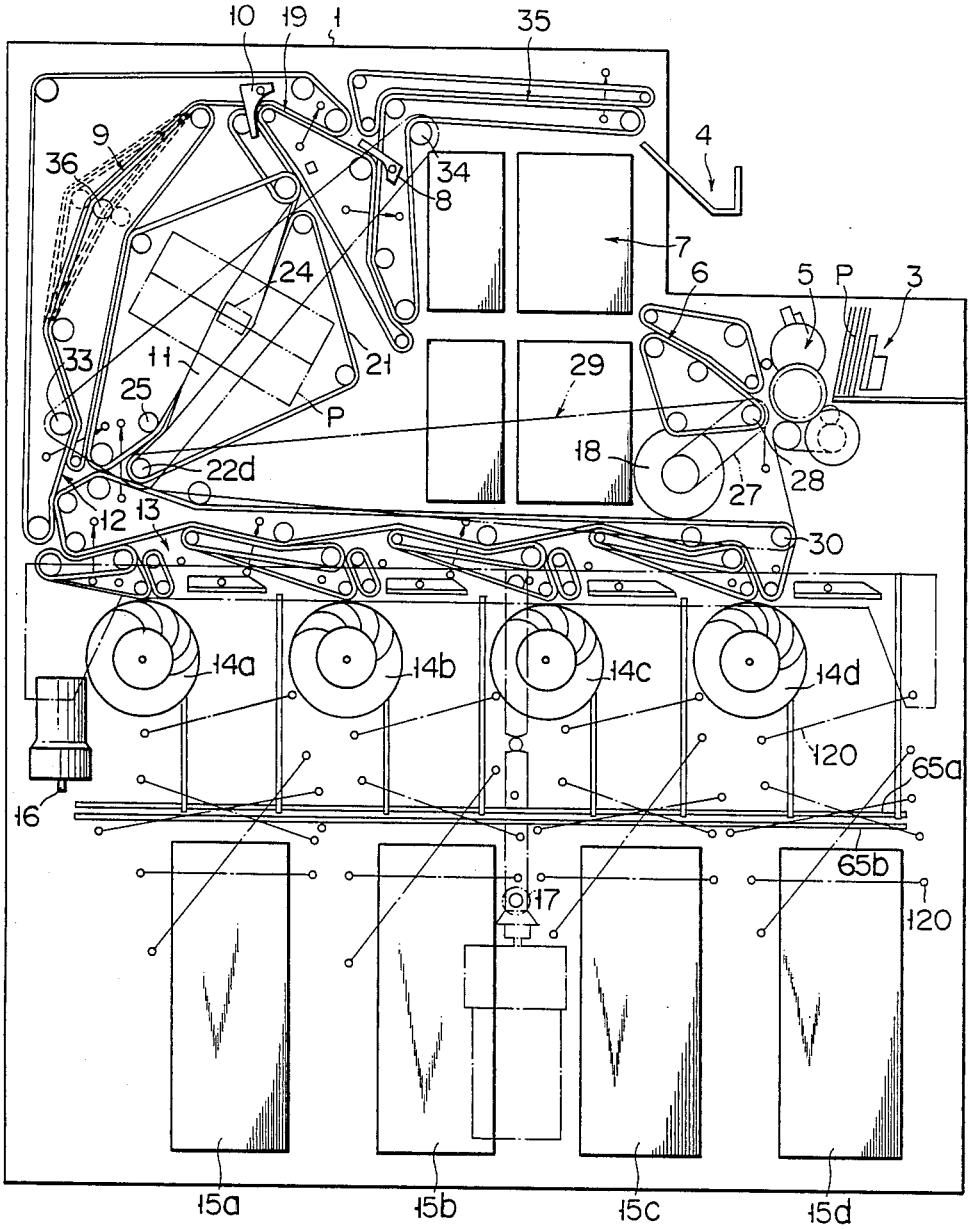
FIG. 5 is a sectional view of the structure of the bill sorting apparatus of this embodiment.

The coin sorting apparatus 202 comprises, as shown in FIG. 1, a coin supply port 260, a stacking section 262 for discriminating coins inserted from the supply port 260 and temporarily stacking each denomination in respective stacking units 262*a* to 262*f*, and a storing unit 264 consisting of stacking units 264*a* to 264*f* which store the coins stacked in the respective stacking units 262*a* to 262*f*. FIG. 4 is a schematic perspective view showing the construction of a bill sorting apparatus. FIG. 5 is a schematic front view showing the construction of the bill sorting apparatus.

Referring to FIG. 4, reference numeral 1 denotes a main housing of the bill sorting apparatus. A display control panel 2 is arranged at the upper right portion of the main housing 1. A bill supply port 3 and a bill rejection port 4 are disposed on the main housing 1 in the vicinity of the display control panel 2. A bill take-in unit 5 is disposed inside the main housing 1 so as to oppose the bill supply port 3, as shown in FIG. 5. Bills P placed in the supply port 3 are taken by the bill take-in unit 5 into the main housing 1 one after another. Each bill P is then conveyed along a take-in convey path 6. The convey direction of the bill is preset to be perpendicular to the longitudinal direction of the bill so as to minimize a convey distance of the bill. The bill passes by a discrimination section 7 for discriminating the denomination, authenticity, fit/unfit, and an obverse-/reverse-presented bill. The discrimination section 7 is disposed midway along the take-in convey path 6. Each bill is thus subjected to discrimination in the discrimination section 7.

The take-in convey path 6 terminates at the upper central portion of the main housing 1. A return path 35 and a central convey path 19 branch from the terminal end of the take-in convey path 6. The return path 35 terminates at the bill rejection port 4. The central convey path 19 terminates at a location spaced a predetermined distance from the terminal end of the convey path 6. A first selector gate 8 is disposed at the terminal end of the take-in convey path 6 to selectively gate the bill to one of the return path 35 and the central convey path 19.

A first convey path 9 for conveying an obverse-presented bill and a second convey path 11 for conveying a reverse-presented bill branch from the terminal end of the central convey path 19. The first and second convey paths 9 and 11 merge at a merge section 12 located at a rear, mid-height portion, and terminate thereat. A second selector gate 10 is disposed at the terminal end of the central convey path 19 to selectively gate a bill which reaches there to one of the first and second convey paths 9 and 11.

When a bill P which is discriminated as a nonspecified bill, it is guided by he first selector gate 8 from the take-in convey path 6 to the return path 35 and then transferred to the bill rejection port 4. However, a specified bill P is guided by the first selector gate 8 from the take-in convey path 6 to the central convey path 19. A bill P which is discriminated by the discrimination section 7 to be an obverse-presented bill is guided by the second selector gate 10 from the central convey path 19 to the first convey path 9. However, a bill P which is discriminated by the discrimination section 7 to be a reverse-presented bill is guided by the second selector gate 10 from the central convey path 19 to the second convey path 11. The second convey path 11 has a side-reversing function, so that the reverse-presented bill can be reversed by this path to an obverse-presented bill. The convey time along the first convey path 9 is the same as that along the second convey path 11. Therefore, bills conveyed at a given pitch are selected by the second selector gate 10 and are conveyed into different convey paths 9 and 11. When the separated bills merge again at the merge section 12, they will not collide with each other since they are conveyed at the same pitch.

The obverse-presented bills P are then conveyed to a sorting convey path 13 as a sorting section connected to the merge section 12, and are sorted in accordance with the four denominations. Stacking units 14*a*, 14*b*, 14*c* and 14*d* for stacking the bills one above another sorted in accordance with the four denominations, and a shutter unit 16 for supporting the bills P stacked in the stacking units 14*a*, 14*b*, 14*c* and 14*d* and for storing the bills in compartments 15*a*, 15*b*, 15*c* and 15*d* disposed below the units 14*a*, 14*b* 14*c* and 14*d*, respectively, as need arises are disposed under the sorting convey path 13. A push-in unit 17 is disposed to firmly push the bills P into the respective compartments 15*a* to 15*d* at the same time.

The second convey path 11 has a twisted convey path 20 as a side reversing convey unit. The leading end and the trailing end of the twisted convey path 20 are twisted by 180°.

Figure 6:
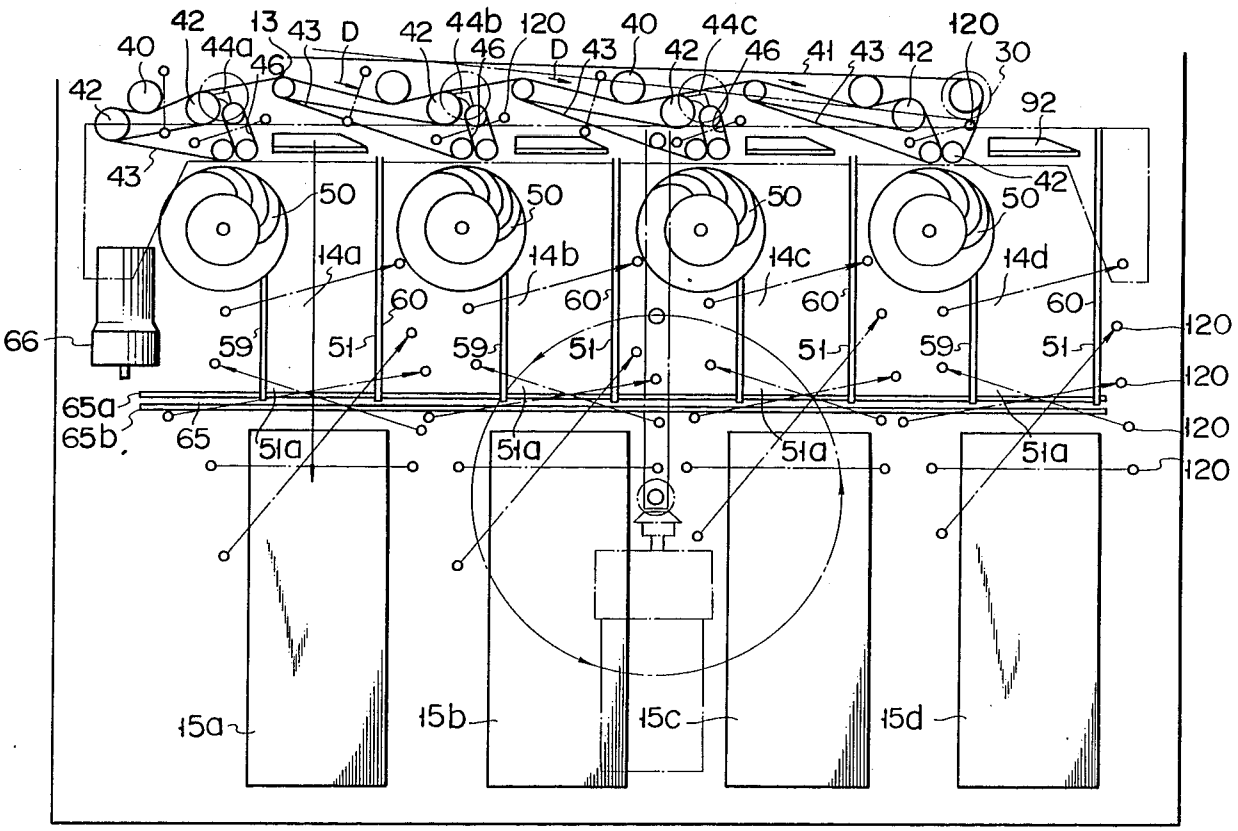
FIG. 6 is a sectional view showing in detail the sorting/stacking section shown in FIG. 5.
Figure 7:
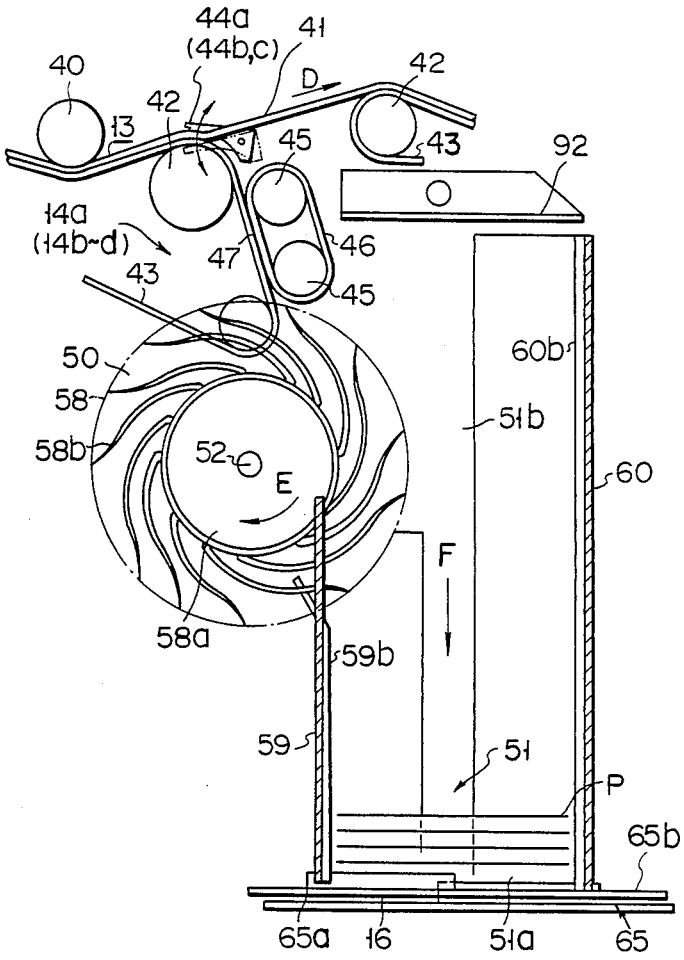
FIG. 7 is a sectional view showing in detail the stacking section shown in FIG. 6.

As shown in FIGS. 6 and 7, the sorting convey path 13 is arranged such that the bill P is clamped and conveyed in the direction indicated by arrow D by opposing surfaces of a conveyor belt 41 looped around a plurality of guide rollers 40 and a drive roller 30 and of four conveyor belts 43 looped around a plurality of guide rollers 42 so as to partially contact with a lower surface of a substantially flat portion of the conveyor belt 41. Selector gates 44*a*, 44*b* and 44*c* for pivotal operation by means of a rotary solenoid (not shown) are disposed at those portions of the sorting convey path 13 which respectively correspond to the first to third stacking units 14*a* to 14*c*. The selector gates 44*a*, 44*b* and 44*c* selectively guide the bills to the stacking units 14*a* to 14*c*, respectively.

The bills sorted by the selector gates 44*a*, 44*b* and 44*c* are respectively conveyed to the first to third stacking units 14*a* to 14*c* through a convey path 47 formed by the opposing surfaces of a substantially vertical portion of the conveyor belt 43 and a conveyor belt 46 looped around a pair of guide rollers 45 so as to partially contact with the substantially vertical portion. The bill P guided to the fourth stacking unit 14*d* is directly conveyed in the fourth stacking unit 14*d* at the trailing end portion of the sorting convey path 13 which is constituted by the opposing surfaces of the conveyor belt 41 and the conveyor belt 43 at the right in FIG. 10. The sorting convey path 13 having the construction described above subsequently clamps and conveys the bills P, conveyed from the merge section 12, by means of the conveyor belts 41 and 43.

When the denomination of the bills P conveyed in accordance with the discrimination result given by the discrimination section 7 is given as the first denomination, the rotary solenoid (not shown) is energized, and the selector gate 44*a* is pivoted clockwise from the position indicated by the two-dots and dashed line (FIG. 7) to the position indicated by the solid line (FIG. 7). Therefore, the first denomination bill or note is guided downward by the selector gate 44a and is guided to the convey path 47. Thereafter, the rotary solenoid (not shown) is deenergized, so that the selector gate 44a returns to the position indicated by the two dots and dashed line (FIG. 7). When the second denomination bill or note is conveyed, the selector gate 44b is operated in the same manner as the selector gate 44a. Similarly, when the third denomination bill or note is conveyed, the selector gate 44c is operated in the same manner as the selector gate 44a. Furthermore, when the fourth denomination bill or note is conveyed, the selector gates 44a, 44b and 44c will not pivot, so that the bill is conveyed to the trailing end of the sorting convey path 13. In this manner, the bills P guided to the sorting convey path 13 are sorted in accordance with the four denominations.

The operation of the stacking units 14a, 14b, 14c and 14d for stacking the sorted bills P will be described with reference to FIG. 7.

The first stacking unit 14a disposed below the selector gate 44a in correspondence therewith, the second stacking unit 14b disposed below the selector gate 44b in correspondence therewith, the third stacking unit 14c disposed below the selector gate 44c in correspondence therewith, and the fourth stacking unit 14d disposed below the trailing end of the sorting convey path 13 have the identical construction. Each of the stacking units 14a to 14d comprises an impeller mechanisms 50 for stacking the sorted bills conveyed along the corresponding convey path 47 or the trailing end of the sorting convey path 13, and a stacking chamber 51 disposed below the corresponding impeller mechanism 50 to stack the bills by guiding the both side edge of the sorted bills.

The detailed construction of the impeller mechanism 50 and the stacking chamber 51 will be described. The impeller mechanism 50 has a shaft 52 both ends of which are rotatably supported by bearings 54 attached to side frames 53. A driven gear 55 is mounted on the shaft 52. A shaft 52a of the guide roller 42 is rotatably attached to the side frames 53. A driving gear 56 is mounted on the shaft 52a. An intermediate gear mechanism 57 is disposed between the driving gear 56 and the driven gear 55, so that, when the guide roller 42 is rotated upon rotation of the drive belt 29, the drive gear 56, the intermediate gear mechanism 57 and the driven gear 55 are subsequently rotated. As a result, the pair of impellers 58 mounted at the intermediate portions of the shift 52 rotate. Each impeller 58 comprises an impeller ring 58a fixed on the shaft 52, and a plurality of blades 58b which are mounted on the circumferential surface of the ring 58a to be spaced apart from each other at equal intervals. The proximal ends of the blades radially extend from the circumferential surface of the ring 58a, and the distal ends thereof are arcuated along a predetermined direction. The distance between the adjacent blades 58b becomes narrower from the distal ends thereof toward the proximal ends thereof. The blades 58b are disposed in a vortex shape. The impellers 58 are mounted on the shaft 52 outside folding lines of the bill P so as not to coincide with these folding lines.

Although an illustration is omitted, even when a folding line which is used to fold the bill P into halves is present in the bill P, this folding line will not coincide with the impellers 58. When the pair of impellers 58 are disposed in this manner, the bill which has a folding line or the like will not cause jamming in the impellers 58.

Each of the stacking chambers 51 is formed between a left wall plate 59 having a pair of notches at its upper portion so as to allow travel of the blades 58b therethrough and a right wall plate 60 which defines a space between itself and the left wall plate 59 to stack the bills P such that bills are stacked in the direction of thickness and which opposes the left side wall 59. Each stacking chamber 51 has upper and lower open ends. The lower opening of the stacking chamber 51 is defined as a dispensing port 51a, and the upper opening thereof is defined as an supply port 51b. A transparent acrylic plate 61 is disposed at the front side of each stacking chamber 51 so as to be freely open/close.

The left and right wall plates 59 and 60 have projections 59b and 60b along the bill drop direction or stacking direction (direction F in FIG. 7). The left and right wall plates 59 and 60 are formed of embossed conductive metal plates, respectively. Therefore, the wall plates have small contact areas with the bills P, so that the bills P can smoothly drop on the shutter unit 16. Furthermore, static electricity generated upon contact between the bills P with the impellers 58 and the conveyor belts 41, 43 and 46 can be properly removed through the projections 59b and 60b. As a result, the irregular dropping and stacking of the bills P which are caused by static electricity can be completely eliminated. The left and right wall plates 59 an 60 may comprise plastic plates coated with a conductive material.

The operation of the stacking units 14a to 14d will be described.

The bills P sorted by the sorting convey path 13 in accordance with the four denominations are conveyed to one of the first to fourth stacking units 14a to 14d. For example, when the first denomination bill or note is conveyed, the bill is guided by the selector gate 44a toward the impellers 58 rotated in the direction indicated by arrow E (FIG. 7). In this case, the impellers 58 are rotated at a peripheral speed corresponding to $\frac{1}{4}$ of the bill convey speed at the sorting convey path 13. The bill P is inserted between the blades 58b of the impellers 58 and is conveyed between the blade 58b and the ring 58a. Upon rotation of the impellers 58, the bill P is slowly conveyed and is removed by the edges of the left wall plate of the stacking chamber 51 defining the notches 59a. The bill P then drops on the shutter unit 16 partitioning the compartments 15a to 15d to be described in detail later. The following bill P carried by the impellers 58 is stacked such that the following bill P is stacked on the preceding bill P.

The shutter unit 16 will be described in detail.

The shutter unit 16 comprises: four first partition plates 65a and four second partition plates 65b, a pair of first and second partition plates being disposed to constitute a bottom plate, under an abutting condition, placed to close the dispensing port 51a of each of the stacking units 14a, 14b, 14c and 14d and which can be spaced apart from each other; and a drive section 66 for reciprocating the partition plates 65a and 65b relative to each other. When the partition plates 65a and 65b are in contact with each other, the dispensing ports 51a are closed. However, when the partition plates 65a and 65b are separated from each other, the dispensing ports 51a are opened. The four first partition plates 65a are connected to each other to move at the same time. Likewise, the four second partition plates 65b are connected to each other to move at the same time. The first and second partition plates 65*a* and 65*b* together constitute a shutter 65.

The compartments 15*a* to 15*d* respectively corresponding to the stacking units 14*a* to 14*d* are disposed under the shutter 65.

Figure 8:
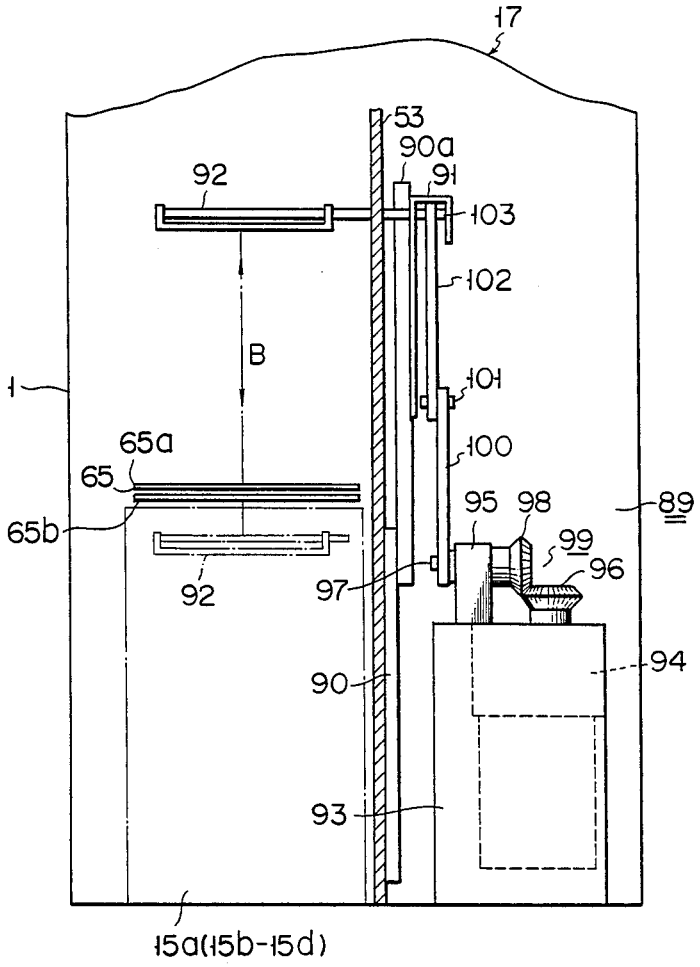
FIG. 8 is a detailed sectional view of a push-in unit shown in FIG. 5.

The push-in unit 17 will be described in detail with reference to FIG. 8. A slide rail 90 which can be vertically moved is mounted such that one end thereof is connected to the side frame 53 fixed to the main housing 1. A moving member 90*a* of the slide rail 90 is mounted on a frame 91 as a movable member. Push-in members 92 are attached to the frame 91 so as to correspond to the stacking chambers 51. The frame 91 is attached to the moving member 90*a*, so that the push-in member 92 is vertically movable in the corresponding stacking chamber 51 (along the direction indicated by arrow B in FIG. 8). A bracket 93 of a moving mechanism 89 for driving the frame 91 is fixed to the main hausing 1. A motor 94 and a bearing box 95 are mounted on the bracket 93. A bevel gear 96 is mounted on the output shaft of the motor 94. A bevel gear 98 is mounted at one end of a shaft 97 in the bearing box 95. The bevel gears 96 and 98 mesh with each other and constitute a power transmission mechanism 99. The power is transmitted from the motor 94 to the shaft 97 through the power transmission mechanism 99. An arm 100 is fixed to the other end of the shaft 97. A link 102 is mounted at the distal end of the arm 100 through a pin 101. A pin 103 is fixed on the frame 91, and the distal end of the link 102 is mounted on the pin 103. In this manner, the rotational force of the motor 94 is converted to a vertical movement and transmitted to the frame 91.

The operation of the push-in unit 17 will be described below.

When a predetermined number of bills P are stacked in the stacking chambers 51, respectively, the shutter unit 16 opens the dispensing ports 51*a*, so that stacks of bills P freely drop in the compartments 15*a* to 15*d*. When the sensor 85 detects that the shutter unit 16 is operated, the moving mechanism 89 f the frame 91 is started. The motor 94 is driven, and the power of the motor 94 is transmitted from the bevel gear 96 to the bevel gear 98. The arm 100 is then rotated counterclockwise through the shaft 97. The link 102 is mounted on the one end of the arm 100 through the pin 101, and the frame 91 is mounted on the link 102 through the pin 103. When the arm 100 is rotated counterclockwise, the push-in members 92 mounted on the frame 91 move downward. Therefore, the push-in members 92 move into the compartments 15*a* to 15*d*, respectively. Therefore, the bills left undropped in the stacking chambers 51 are pushed into the compartments 15*a* to 15*d*, respectively. When the arm 100 rotates through 180°, the frame 91 reaches the bottom dead point. When this is detected by a sensor 105, the push-in operation is completed. In other words, when the arm 100 revolves once, the frame 91 reciprocates once.

Some bills P are stacked in a standing posture in the stacking chambers 51. By utilizing the push-in mechanism, the standing bills can be properly stored. Projections 59*b* and 60*b* are respectively formed in the wall plates 59 and 60 of each stacking chamber 51. Each push-in member 92 has notches 92*a* nested with the corresponding projections 59*b* and 60*b*. Even if the standing bills are present in the stacking chambers, they can be properly pushed into the corresponding compartments 15*a* to 15*d*.

In the push-in unit 17 operated as described above, the bills P stacked in the plurality of stacking chambers 51 are pushed in the corresponding compartments 15*a* to 15*d* at once. Therefore, unlike the conventional structure wherein four independent push-in units are disposed for the first to fourth stacking chambers and the corresponding compartments, the bills can be simultaneously pushed into the corresponding compartments according to the present invention. In this manner, only one drive unit is required, and the number of parts can be decreased, thereby reducing the cost to about $\frac{1}{4}$ the conventional cost.

Figure 9A:
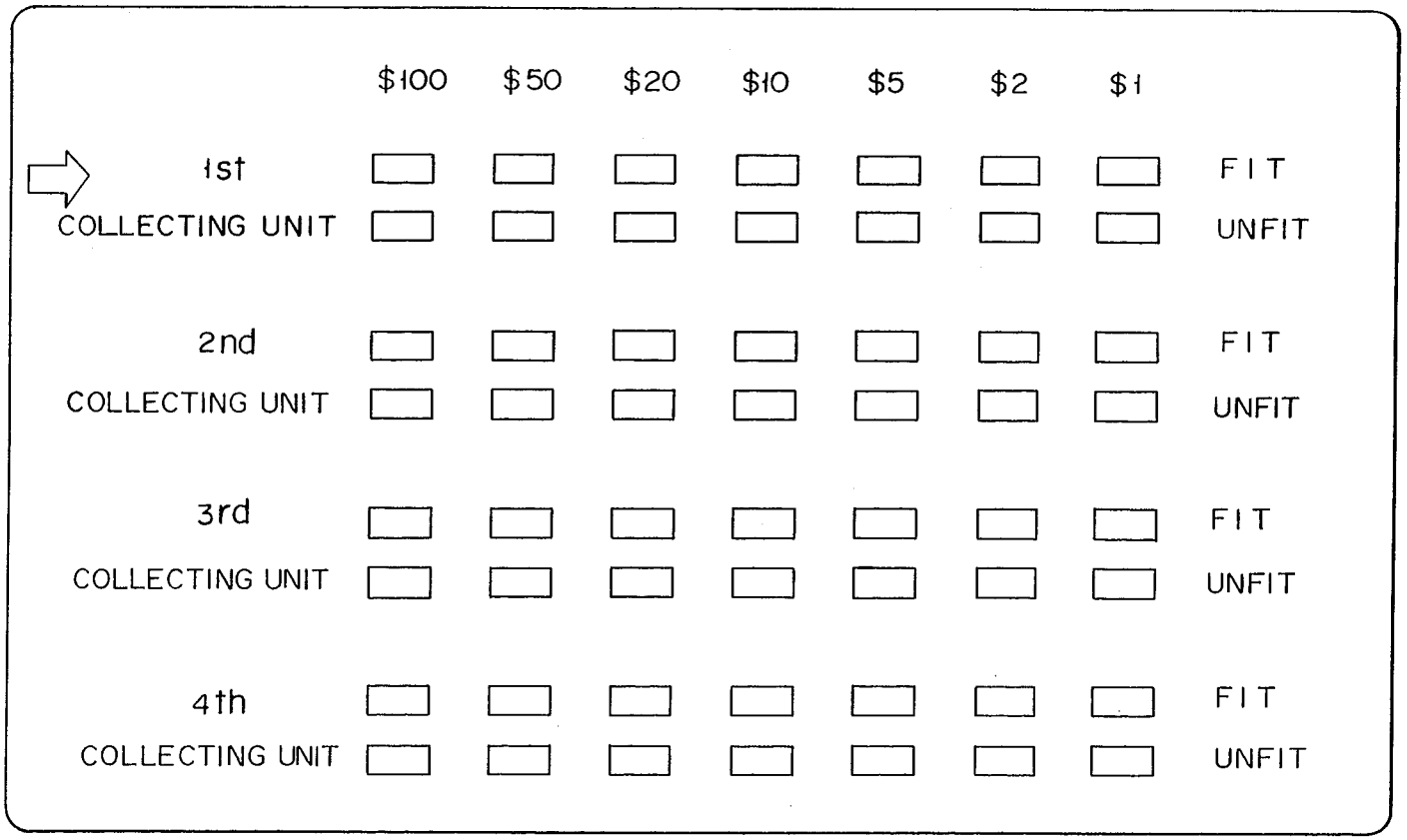
FIGS. 9A and 9B are views showing a CRT display in the denomination specification operation of this embodiment.
Figure 9B:
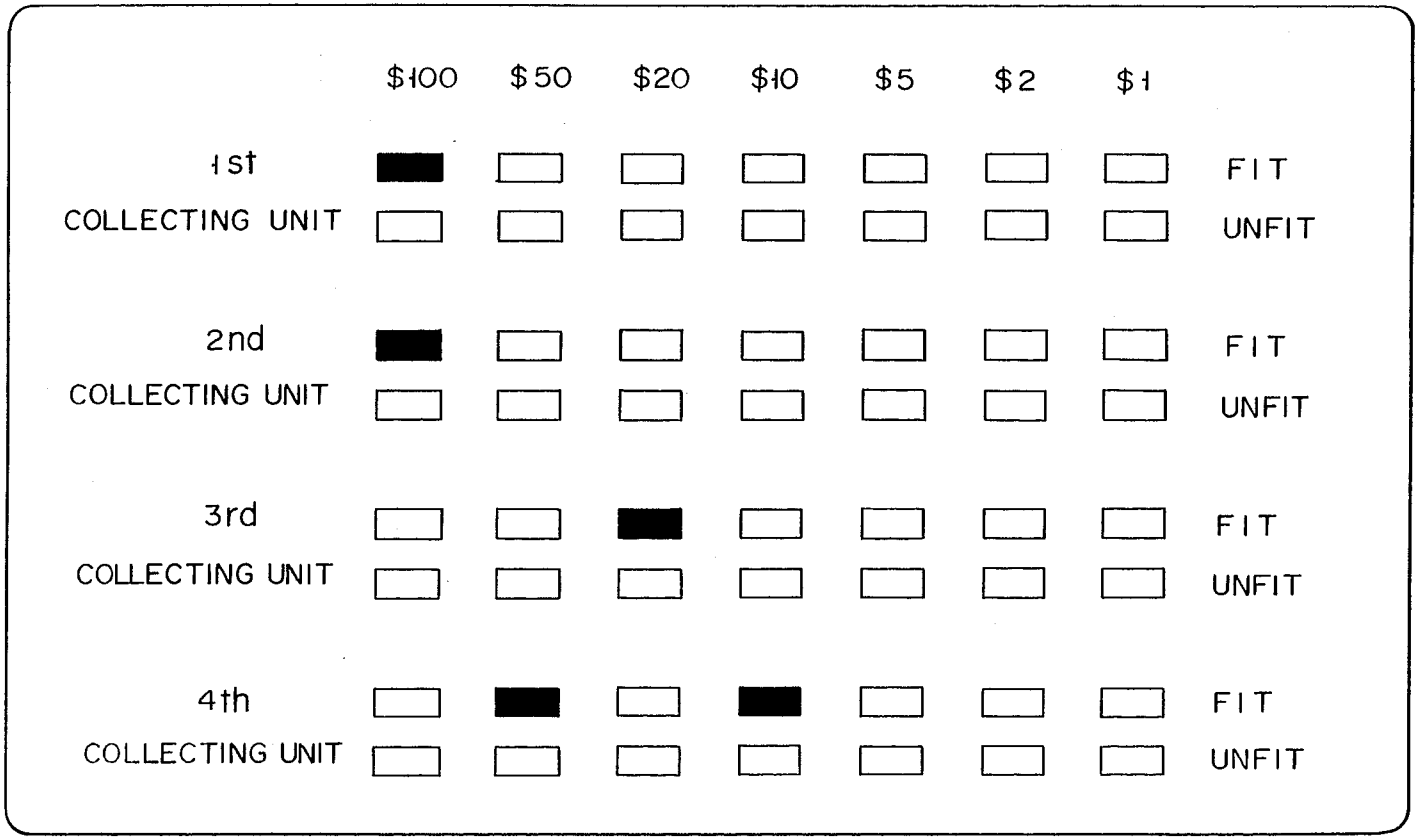

Next, the operation of this embodiment will be described. In this embodiment, the four stacking units 14*a* to 14*d* are provided, but the denominations of bills which are stacked in the respective stacking units are not determined. For this reason, the denomination specification operation must be made first. Bills other than the specified ones are stacked in the bill rejection port 4. When the mode switch 230 is set in the program mode, the CRT display 208 has the display shown in FIG. 9A. In FIG. 9A, the arrow displayed at the left side of the representation of the "first stacking unit" shows that the denomination of the bills which are stacked in the first stacking unit can be specified. In this state, the denomination of the bills which are stacked in the first stacking unit is specified by using the denomination key 236 and the fit and unfit keys 252 and 254. For example, when the fit $100 bills are to be stacked in the first stacking unit, the $100 denomination key 236 and the fit key 252 are both depressed. Then, the specified denomination is displayed on the screen. If bills of other denomination are to be stored in the first stacking unit in addition to $100 bills, the denomination key 236 corresponding to other denomination is also depressed. When the specification operation of the denomination to be stacked in the first stacking unit is completed, the program key 256 is depressed, and the arrow positioned to the left side of the representation of the "first stacking unit" moves to the left side of the representaion of the "second stacking unit". Then, the arrow shows that the denomination of the bills which are to be stacked in the second stacking unit can be specified. In the same manner as described above, the specification operation of the denominations corresponding to the second, third, fourth stacking units are performed. When the denomination specification operation with respect to all the stacking unit is finished, the screen of the CRT display 208 displays what is shown in FIG. 9B. In this embodiment, fit bills of $100 are stacked in first and second stacking units, fit bills of $20 are stacked in the third stacking unit, and the fit bills of $50 and $10 are stacked in the fourth stacking unit. Bills other than the above-mentioned bills (i.e., fit bills of $5, $2 and $1, and unfit bills of all denominations) are stacked in the bill rejection port 4. Thereafter, when the complete key 242 is depressed, specified denomination data corresponding to the respective stacking units designated in this manner are supplied to the stacking control table 224. The stacking control table 224 consists of a nonvolatile read/write memory element and the specified denomination data is permanently stored therein, until the contents are changed. For this reason, if a power source is turned off, this specified denomination data is not erased. Therefore, the denomination specification operation does not have to be performed every time the power source is turned on. In this manner, according to this embodiment, the denomination of the bills to be stacked in the respective stacking units can be easily changed and reset.

Figure 10:
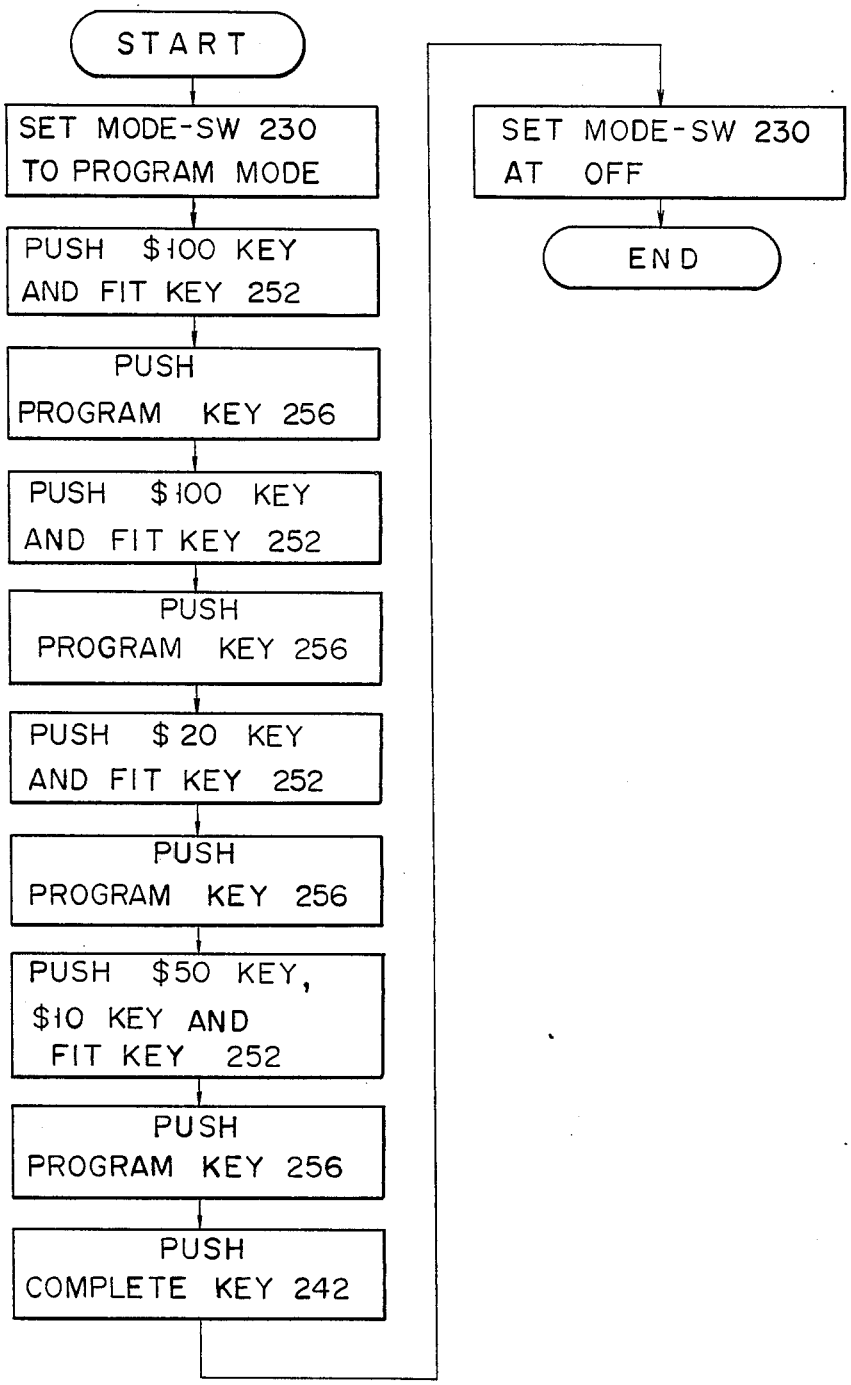
FIG. 10 is a flow chart for explaining the denomination specification operation of this embodiment.

FIG. 10 shows a flow chart of operation steps when the denomination is specified, as described above.

Figures 11, 12:
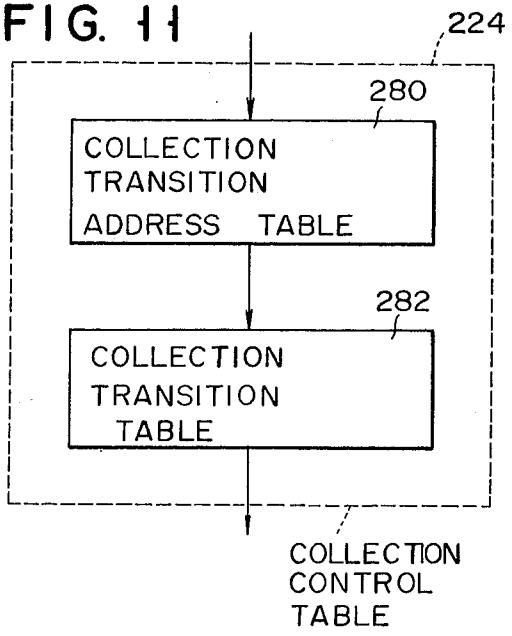
FIG. 11 is a block diagram showing in detail the stacking control table shown in FIG. 2.
FIG. 12 is a block diagram showing in detail the stacking transition address table shown in FIG. 11.

The detailed structure of the stacking control table 224 is shown in FIG. 11. The stacking control table 224 consists of the stacking transition address table 280 and the stacking transition table 282 which respectively consist of a nonvolatile read/write memory element. Each bill is discriminated upon being conveyed through this sorting apparatus, and discrimination data as this discrimination result is supplied to the stacking transition address table 280 in the stacking control table 224. An output from the stacking transition address table 280 is supplied to the stacking transition table 282, and an output from the stacking transition table 282 is supplied to various gates, thereby stacking conveyed bills in the specified stacking unit.

Figure 13:
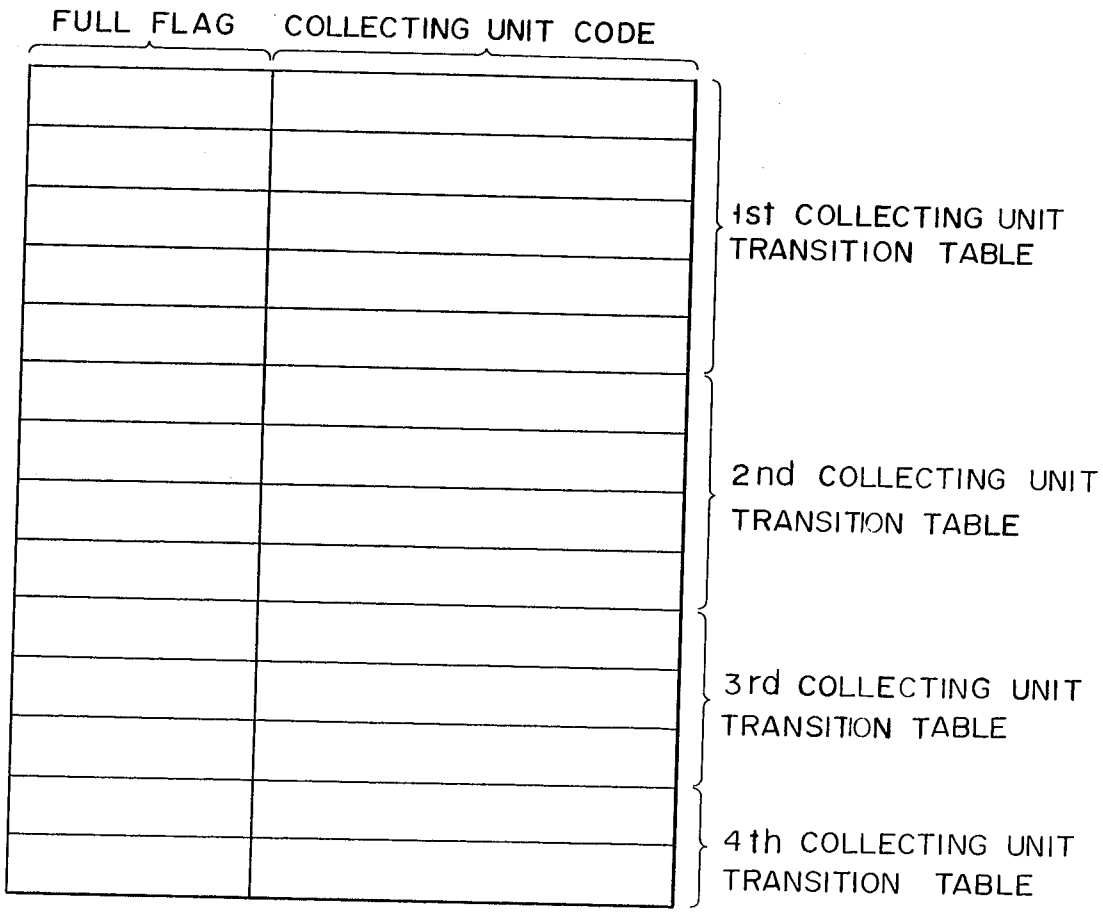
FIG. 13 is a block diagram showing in detail the stacking transition table shown in FIG. 11.

As shown in FIG. 12, the stacking transition address table 280 stores table addresses which represent which address table in the stacking transition table 282 needs to be referred to for each denomination, respectively. As shown in FIG. 13, the stacking transition table 282 is divided into four parts corresponding to the respective stacking units 14*a* to 14*d*, and the table addresses show the start address of the respective table address in the stacking transition address table 280. These table addresses can be set by the denomination specification shown in FIG. 10. When bills of one denomination (the fit $100 bills in the former example) are stacked in a plurality of stacking units (first and second stacking units in the former example), the start address of the stacking unit in which the bills are stacked first (i.e., the first stacking unit) is set.

As shown in FIG. 13, the stacking transition table 282 comprises transition tables for every stacking unit. The respective tables consist of a full flag which represents whether or not the corresponding stacking unit is full, and stacking unit codes which represent which stacking unit the bills are transferred to and stacked in. The stacking unit codes are $\alpha$, $\beta$, $\gamma$, $\delta$, and $\theta$, and are codes for stacking bills in the first stacking unit 14*a*, the second stacking unit 14*b*, the third stacking unit 14*c*, the fourth stacking unit 14*d* and the rejection port 4. The full flag is set when the corresponding stacking unit is full, and is reset when this full state is released. The stacking unit codes are set when the denomination specification operation as described above is performed, and are not changed if the specified denomination is changed.

Figure 14:
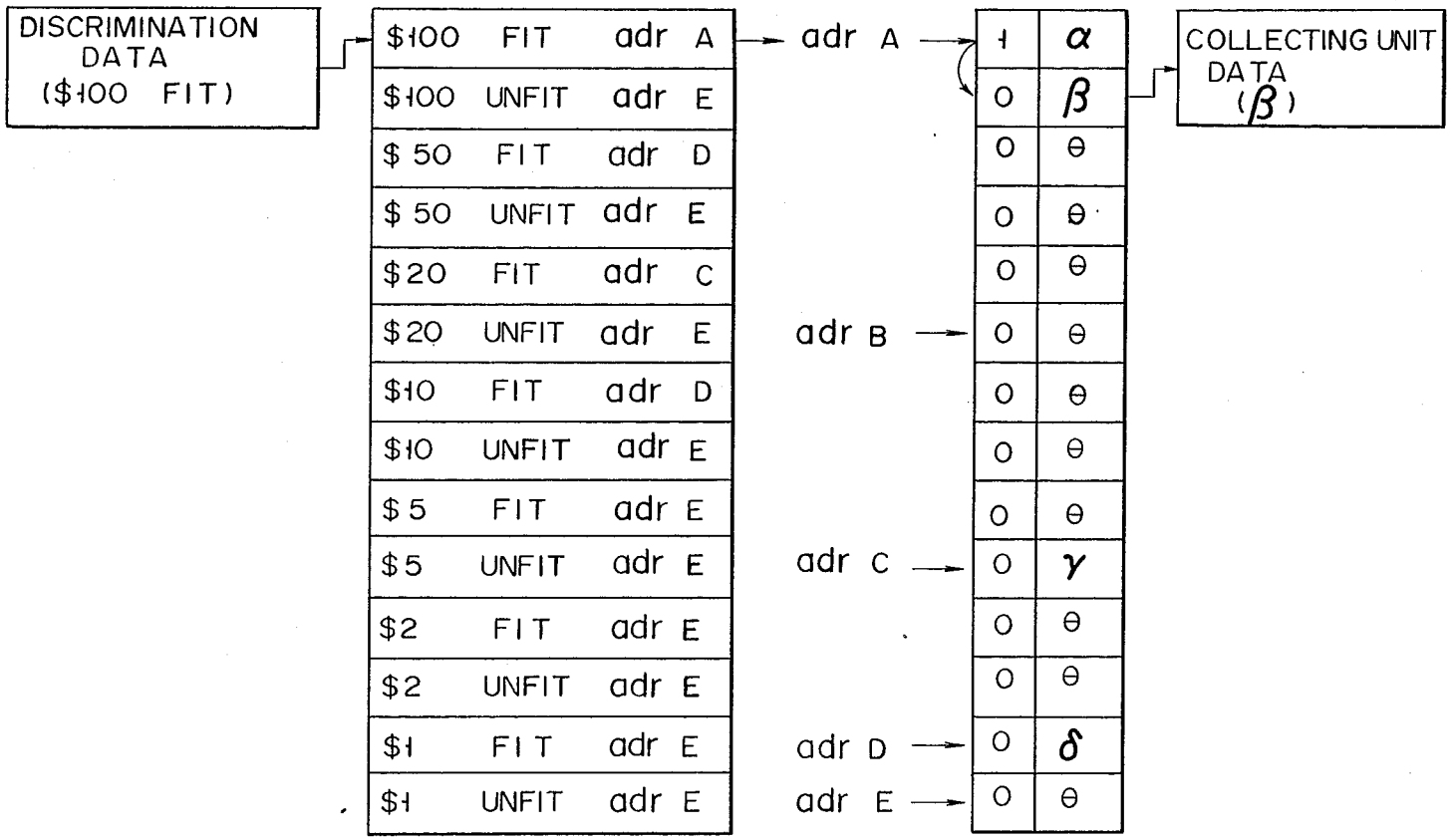
FIG. 14 is a block diagram showing the stacking control table when the denomination specification operation shown in FIG. 10 is performed.

When the denomination specification operation is performed as shown in FIG. 10, the stacking control table 224 (where fit $100 bills are stacked in the first and second stacking units, fit $20 bills in the third stacking unit, fit $50 bills and $10 in the fourth stacking unit) is shown in FIG. 14. In FIG. 14, reference symbol adrA denotes a start address of the transition table for the first stacking unit; adrB, a start address of the transition table for the second stacking unit; adrC, a start address of the transition table for the third stacking unit; adrD, a start address of the transition table for the fourth stacking unit; and adrE, an end address of the stacking transition table 282. Referring to FIG. 14, the algorithm for determining designated destination of the bills in accordance with discrimination data from the discrimination unit 7 will now be described. Assume that the discrimination data represents the fit $100 bill. The table address adrA in the stacking transition address table 280 corresponding to this discrimination data is read out. The transition table of the stacking transition table 282 for the first stacking unit is referred in accordance with this table address adrA. Since the full flag of the table addressed by the table address adrA is "1", and since the bills cannot be stacked in this stacking unit, the address is increased by "+1", and then the full flag of the next address is checked. In this manner, the full flag is checked while the address is sequentially increased, and the stacking unit code $\beta$ of the stacking unit to be stacked can be obtained from the first table that is not full. In this case, the stacking unit code for stacking the bills in the second stacking unit 14*b* can be obtained.

Finally, the entire operation will be described hereinafter. An operator sets the mode specification switch 230 to the operator mode after the above specification operation is performed, and inserts bills in the bill supply port 3 of the bill sorting apparatus 200, and depresses the start key 240. Then, the main controller 212 drives the bill sorting appratus 200, and illuminates the start key 240. The bills are taken one by one by the bill take-in unit 5 into the bill sorting apparatus 200, and their denomination, and fit/unfit state is discriminated by the discrimination unit 7. This discrimination data is supplied t the main controller 212 through the interface 222. The main controller 212 reads out the stacking unit code in accordance with the discrimination data from the stacking control table 224, and supplies it to the bill sorting apparatus 200. As a result, the bills are stacked in the specified stacking units in accordance with their denomination and fit/unfit state. The main controller 212 simultaneously checks whether or not each stacking unit is full. When the main controller 212 finds a full stacking unit, the full flag of the stacking transition table for the full stacking unit is set. For this reason, if the bills of one denomination which are specified to be stacked in the full stacking unit are specified to be stacked in another stacking unit, the stacking operation to another stacking unit can be automatically and continuously performed without stopping the sorting operation.

The denomination specification operation for each stacking unit is performed by depressing the keys on the operation panel 206 in the above embodiment. However, this operation can also be performed by using the ID card reader 226 so as to read data previously stored in ID cards, or by using the DIP switches 228.

As described above, according to the present invention, there is provided a paper sheet sorting apparatus which can easily change/set denominations of paper sheets sorted/stacked in respective stacking units. Paper sheets of an identical denomination can be continuously stacked in a plurality of stacking units by specifying the denominations of the corresponding stacking units. Therefore, if one of the stacking units becomes full, processing efficiency can be improved without stopping the sorting operation.

What is claimed is:

1. A paper sheet sorting apparatus comprising:

a paper sheet supply port at which a plurality of paper sheets of various kinds are set;

a pick-up unit for picking up the paper sheets one by one from said paper sheet supply port;

a discrimination unit for discriminating between kinds of the paper sheets picked up by said pick-up unit;

a plurality of stacking units in which the paper sheets picked up by said pick-up unit are to be stacked;

specification means for specifying the kinds of the paper sheet to be stacked in each of said stacking units; and stacking control means for stacking the paper sheets picked up by said pick-up unit in each said stacking unit as specified by said specification means in accordance with a discrimination result of said discrimination unit, wherein said specification means can be set such that the paper sheets of identical kind are stacked in more than two said stacking units, and when one stacking unit in which the specified sheets are currently stacked is full, said stacking control means automatically changes a stacking designation to another of said specified stacking units which is not full, and wherein said specification means comprises a full flag for representing whether or not said stacking unit which is currently used is full when the paper sheets of the identical kind are stacked in more than two stacking units, a stacking transition table comprising stacking unit codes for representing in which said stacking unit the paper sheets currently stacked are to be stacked next when said stacking unit in which the paper sheets are currently stacked is full, and a stacking transition address table for referring to said stacking transition table in accordance with a discrimination result of said discrimination unit.

2. An apparatus according to claim 1, wherein said stacking unit codes and said stacking transition address table of said stacking transition table are specified by said specification means.

3. An apparatus according to claim 1, wherein said stacking transition table and said stacking transition address table comprise nonvolatile read/write memory elements.

4. A paper sheet sorting apparatus according to claim 1, wherein said specification means is capable of specifying that a plurality of kinds are to be stacked in each of said stacking units.

5. An apparatus according to claim 1, in which said kinds of paper sheets are selected from at least one of denomination and fitness/unfitness of said paper sheets.

6. A paper sheet sorting apparatus comprising:

a paper sheet supply port at which a plurality of paper sheets of various kinds are set;

a pick-up unit for picking up the paper sheets one by one from said paper sheet supply port;

a discrimination unit for discriminating between kinds of the paper sheets picked up by said pick-up unit;

a plurality of stacking units in which the paper sheets picked up by said pick-up unit are to be stacked;

specification means for specifying the kinds of the paper sheet to be stacked in each of said stacking units;

a first table for storing stacking unit codes representing said stacking units which are classified based on the kinds specified by said specification means;

a second table for storing address data to be read out from said first table based on the specification of the kinds of the paper sheets, said first and second tables being formed by the specification of said specification means; and stacking control means for stacking the paper sheets picked up by said pick-up unit in said stacking units in accordance with the stacking unit codes read out from an address of said first table which is read out from the second table in accordance with the discrimination result of said discrimination unit;

wherein said specification means can be set such that the paper sheets of identical kind are stacked in more than two said stacking units, and when one stacking unit in which the specified sheets are currently stacked is full, said stacking control means automatically changes a stacking designation to another of said specified stacking units which is not full, and wherein said specification means comprises a full flag for representing whether or not said stacking unit which is currently used is full when the paper sheets of the identical kind are stacked in more than two stacking units, a stacking transition table comprising stacking unit codes for representing in which said stacking unit the paper sheets currently stacked are to be stacked next when said stacking unit in which the paper sheets are currently stacked is full, and a stacking transition address table for referring to said stacking transition table in accordance with a discrimination result of said discrimination unit.

7. A paper sheet sorting apparatus according to claim 6, wherein said specification means is capable of specifying that a plurality of kinds are to be stacked in each of said stacking units.

8. An apparatus according to claim 6, wherein said stacking units codes and said stacking transition address table of said stacking transition table are specified by said specification means.

9. An apparatus according to claim 6, wherein said stacking transition table and said stacking transition address table comprise nonvolatile read/write memory elements.

10. An apparatus according to claim 6, in which said kinds of paper sheets are selected from at least one of denomination and fitness/unfitness of said paper sheets.

11. A paper sheet sorting apparatus comprising:

a paper sheet supply port at which a plurality paper sheets of various kinds are set;

a pick-up unit for picking up the paper sheets one by one from said paper sheet supply port;

a discrimination unit for discriminating between kinds of the paper sheets picked up by said pick-up unit;

a plurality of stacking units in which the paper sheets picked up by said pick-up unit are to be stacked;

specification means for specifying the kinds of the paper sheet to be stacked in each of said stacking units;

a first table for storing stacking unit codes representing said stacking units which are classified based on the kinds specified by said specification means;

a second table for storing address data to be read out from said first table based on the specification of the kinds of the paper sheets, said first and second tables being formed by the specification of said specification means; and stacking control means for stacking the paper sheets picked up by said pick-up unit in said stacking units in accordance with the stacking unit codes read out from an address of said first table which is read out from the second table in accordance with the discrimination result of said discrimination unit;

said stacking unit codes representing the stacking units, in which paper sheets of the same kinds are stacked, being stored in successive addresses and each of said stacking unit codes comprising a full flag set when the corresponding stacking unit is full, a stacking unit code in the nearest address to which the full flag is not set being accessed when the stacking unit code to which the full flag is set is accessed;

wherein said specification means can be set such that the paper sheets of identical kind are stacked in more than two said stacking units, and when one stacking unit in which the specified sheets are currently stacked is full, said stacking control means automatically changes a stacking designation to another of said specified stacking units which is not full, and wherein said specification means comprises a full flag for representing whether or not said stacking unit which is currently used is full when the paper sheets of the identical kind are stacked in more than two stacking units, a stacking transition table comprising stacking unit codes for representing in which said stacking unit the paper sheets currently stacked are to be stacked next when said stacking unit in which the paper sheets are currently stacked is full, and a stacking transition address table for referring to said stacking transition table in accordance with a discrimination result of said discrimination unit.

12. An apparatus according to claim 11, wherein said stacking unit codes and said stacking transition address table of said stacking transition table are specified by said specification means.

13. An apparatus according to claim 11, wherein said stacking transition table and said stacking transition address table comprise nonvolatile read/write memory elements.

14. An apparatus according to claim 11, in which said kinds of paper sheets are selected form at least one of denomination and fitness/unfitness of said paper sheets.

* * * * *